US005125463A

United States Patent [19]

Livingstone et al.

[11] Patent Number: 5,125,463

[45] Date of Patent: Jun. 30, 1992

[54] ADJUSTABLE BENT SUB

[76] Inventors: Raymond S. S. Livingstone, 51568 Range Road, 225, Sherwood Park, Alberta, Canada, T8C 1H5; Raymond D. Livingstone, 7404 33rd Avenue, N.W., Edmonton, Alberta, Canada, T6K 1J4

[21] Appl. No.: 636,433

[22] Filed: Dec. 31, 1990

[51] Int. Cl.[5] ..... E21B 7/08

[52] U.S. Cl. ..... 175/74; 175/320; 166/237; 285/93; 285/184

[58] Field of Search ..... 175/61, 73, 74, 75, 175/62, 320; 285/184, 93; 166/237, 240

[56] References Cited

U.S. PATENT DOCUMENTS 4,077,657 3/1978 Trzeciak ..... 285/184
4,303,135 12/1981 Benoit ..... 175/73
4,745,982 5/1988 Wenzel ..... 175/74
4,813,497 3/1989 Wenzel ..... 175/74
4,817,740 4/1989 Beimgraben ..... 175/74
5,029,654 7/1991 Wilson et al. ..... 175/74

*Primary Examiner*—Terry Lee Melius
*Attorney, Agent, or Firm*—Wenderoth, Lind & Ponack

[57] ABSTRACT

An adjustable bent sub for a down hole drill is disclosed consisting of a hollow housing and a hollow mandrel shaped to fit within the housing. A jam nut is positioned on the end of the mandrel to retain it within the housing by abutting a shoulder provided on the inner surface of the housing. A 1 degree off-normal face is machined on the shoulder and on the abutting face of the jam nut. By positioning the mandrel/jam nut assembly at different angular positions with respect to the housing, a linear deviation of 0 to 2 degrees is possible through the length of the sub.

10 Claims, 10 Drawing Sheets

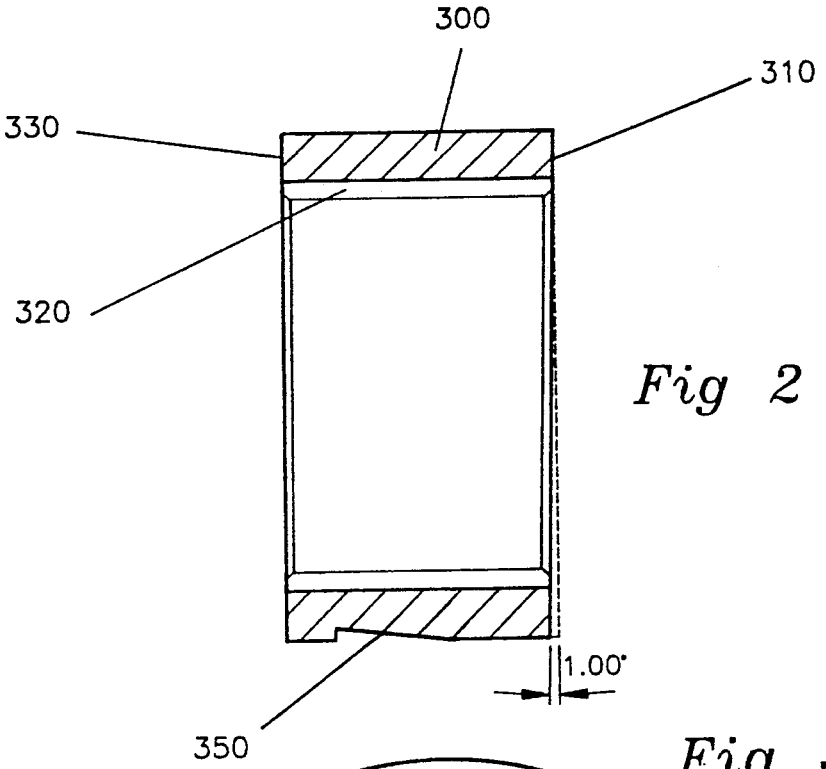
Fig 2
Fig 3a
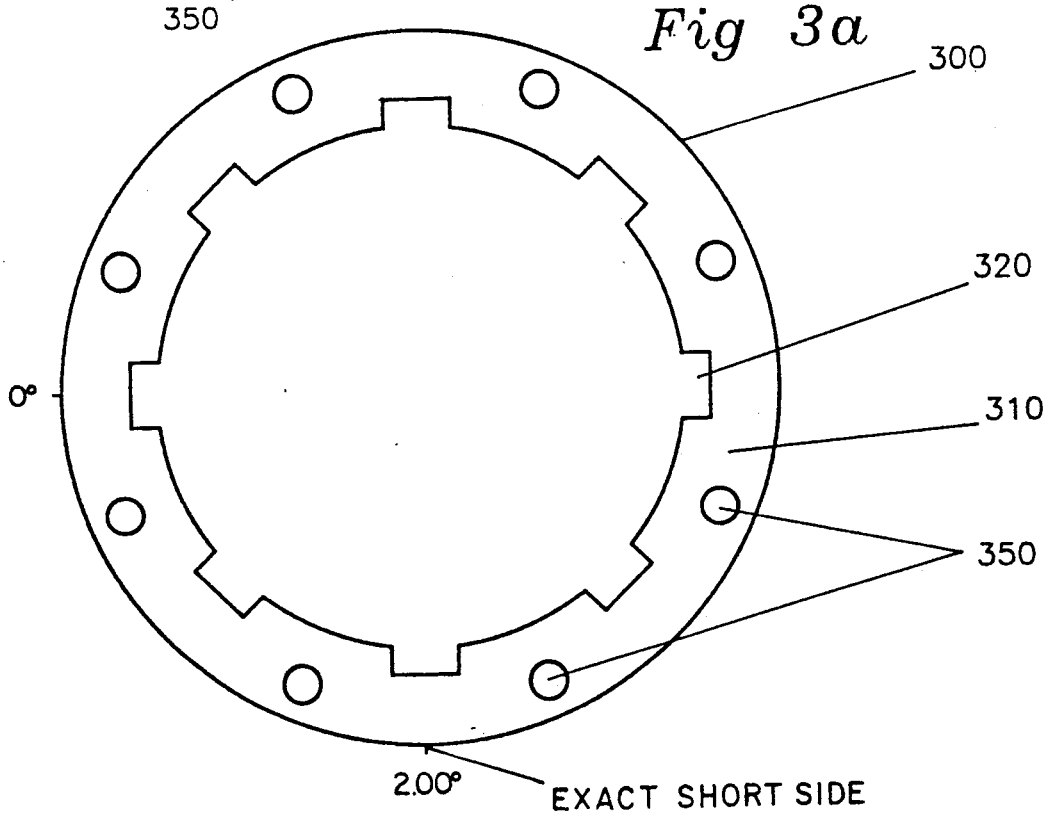

ADJUSTABLE BENT SUB

BACKGROUND OF THE INVENTION

This invention relates to downhole drilling systems for oil and gas exploration, and in particular, to a device known as an adjustable bent sub for altering the direction of a drill down a drill hole.

It is known in the prior art to provide subs for downhole drilling systems which are slightly bent in order to effect a change in vertical angle of direction of the drill bit. By providing a slight bend in the sub, the drill bit is encouraged to continue drilling at a slightly different angle below the sub than the angle made by the drill stem above the sub. In this manner, the drill bit may be made to follow a course which is not simply a vertical course but may be made to change direction to take account of changes in the composition of the earth, for example, to avoid certain obstacles or to drill out towards an underwater location.

It is desirable to provide an adjustable bent sub to avoid the necessity of having many different and expensive subs available on site, depending upon the angle of bend desired. It is much preferable to have a single unit which is capable of being adjusted to meet any required angle.

Trzeciak, U.S. Pat. No. 4,077,657 teaches one such adjustable bent sub. The sub is comprised of two longitudinal parts for passage of the drill stem therethrough, with mating faces between the parts, each such face being provided at an angle slightly off normal with respect to its respective axis. By rotating one of the parts about its axis relative to the other part, the degree of bend through the sub can be varied. Each mating face is provided with dog teeth and a lock nut is located internally to hold the two parts in a chosen relative angular displacement with respect to each other.

Wenzel, U.S. Pat. No. 4,745,982 also discloses an adjustable bent sub comprised of two parts with mating faces between the parts. However, unlike Trzeciak, the faces are normal to their axes, and a non-adjustable angular deviation is provided in the body of each part at a point somewhat removed from the mating faces in order to give the required deviation. In this case, the adjustable sub may be adjusted by disengaging the two parts, re-engaging the mating dog teeth of the two parts at the chosen relative angular displacement and re-securing the apparatus by means of lock nuts. However, when set to the 0° position, the adjustable sub does not provide a straight through conduit for the drill bit but is always offset by a certain amount.

It is an object of the present invention to provide an adjustable bent sub apparatus which is simple to adjust accurately in the field to a desired angular deviation.

SUMMARY OF THE INVENTION

According to one broad aspect of the invention, there is thus provided an adjustable bent sub for a down hole drilling system including hollow cylindrical box means having a first end and a second end and having internal shoulder means disposed on a plane inclined at a predetermined angle from normal to the axis of the hollow cylindrical box means; hollow cylindrical pin means adapted to be slidably inserted within the first end of the box means; pin retaining means adapted for attachment to the inserted end of the pin means and having a face inclined at the predetermined angle from normal to the axis of the pin retaining means for engagement with the internal shoulder means for retaining the pin means within the box means; tightening means for tightening the pin means to the box means; whereby the pin means may be rotatably adjusted within the box means prior to tightening of the tightening means to provide an adjustable angular deviation in the axis of the sub.

BRIEF DESCRIPTION OF THE DRAWINGS

The apparatus of the invention will now be described with reference to the accompanying drawings, in which:

FIG. 2 is a longitudinal sectional view of the kick ring;

FIG. 3*a* is an end view of the kick ring of FIG. 2;

DETAILED DESCRIPTION OF THE INVENTION

Figure 1:
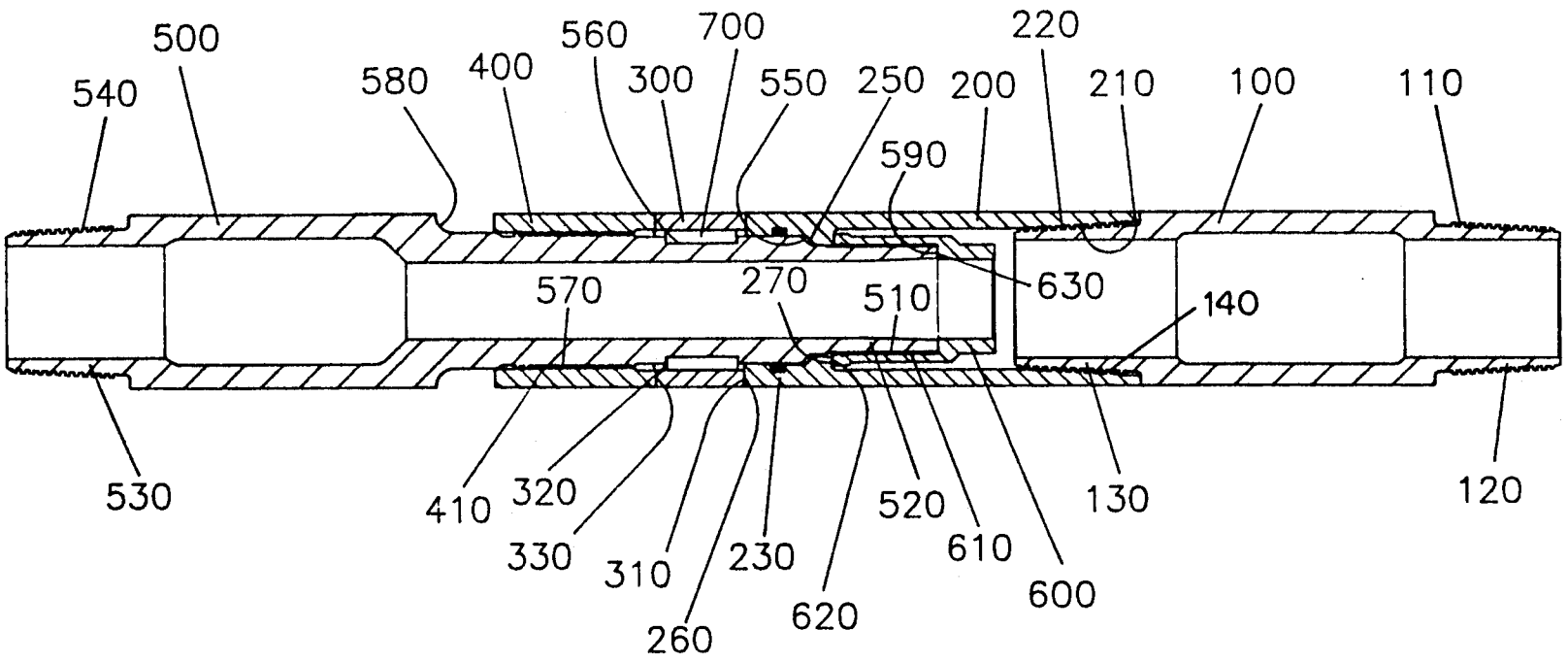
FIG. 1 is a longitudinal sectional view of the assembled apparatus of the invention.

Turning to FIG. 1, the adjustable bent sub of the invention is shown in assembled form. Top sub 100 is provided with an externally threaded section 110 at its upper end 120 for mating to stator equipment, i.e., the powered section of a mudmotor. At its lower end 130, it is provided with a further externally threaded section for threadable engagement with internally provided threads 210 on the upper end of the housing 200.

Mandrel 500 has a set of external threads 540 located at the bottom end 530 suitable for engaging the bearing assembly of a mud motor. An upper end 520 is shaped to fit within the lower end 230 of the housing, a shoulder 550 being provided to abut a shoulder 250 disposed inside the lower end 230 of housing 200.

Figure 12:
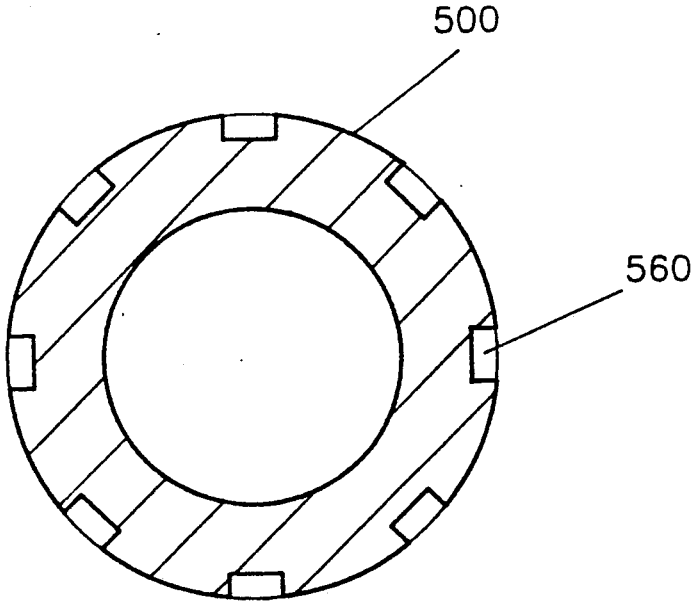
FIG. 12 is a cross-sectional view taken along line A—A of the mandrel of FIG. 11.
Figure 11:
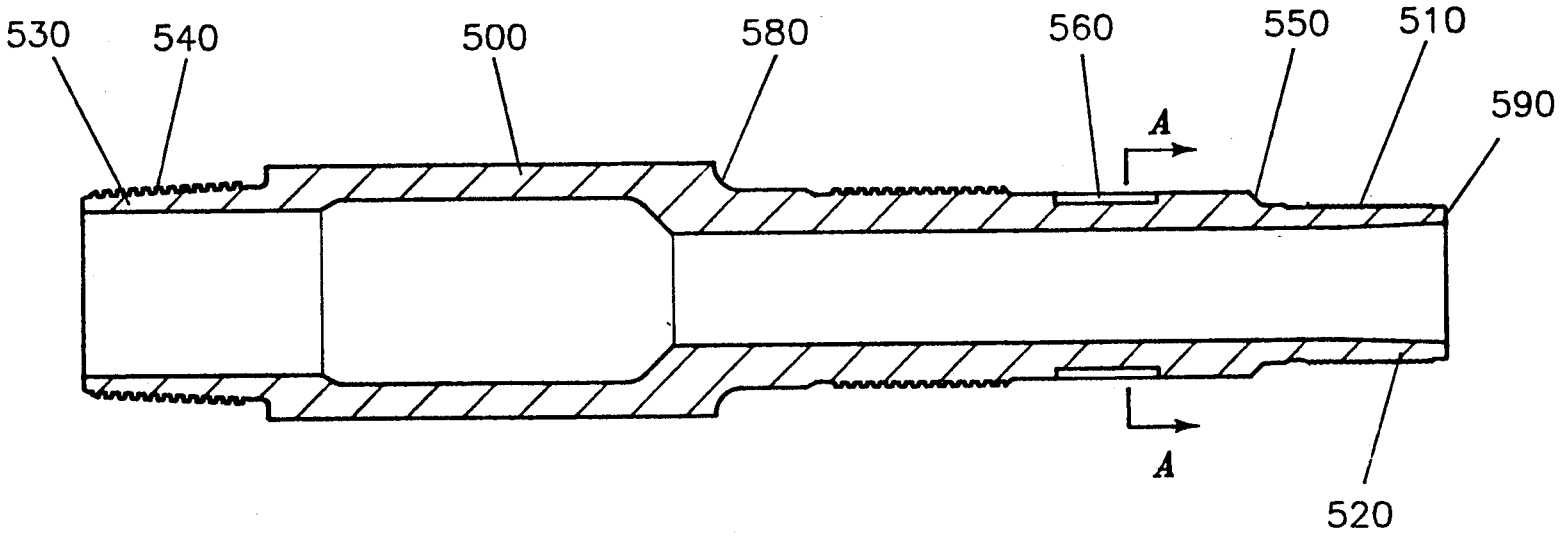
FIG. 11 is a longitudinal sectional view of the mandrel.

A kick ring 300 is provided around mandrel 500 and held in position from turning relative to the mandrel by 8 keys (700). Eight slots 560 are located longitudinally in the mandrel 500 as shown in FIG. 12 equally spaced at intervals of 45 degrees about the circumference of the mandrel. FIG. 3 shows eight corresponding slots 320 provided inside the kick ring to engage the eight keys 700. These keys hold the kick ring 300 in position in order to prevent the kick ring from rotating relative to mandrel 500.

In addition, eight equally spaced holes 350 are provided in face 310 of the kick ring into which eight dowel pins (not shown) are located. 16 similar equally-spaced holes (not shown) are provided in face 260 of the housing to receive the eight dowel pins in order to provide a mating between the two faces to prevent angular slippage between the two. The kick ring 300 may be slid along the keys 700 so that face 310 of kick ring 300 comes into contact with face 260 of housing 200, and the eight dowel pins will engage eight of the sixteen holes in the face 260 of the housing.

A retaining nut 400 is provided around mandrel 500 below the kick ring 300 to retain the kick ring against the face of the housing. This retaining nut has a set of internal threads 410 adapted to engage with a set of external threads 570 provided on the exterior surface of the mandrel 500. Shoulder 580 is provided on the outside of the mandrel to act as a stop for retaining nut 400 to prevent it moving more than approximately ½ inch to the left as shown in FIG. 1 when it is loosened. When retaining nut 400 is loosened, kick ring 300 may be slid down along keys 700 so that shoulder 250 of the housing may come to rest on shoulder 550 of the mandrel, thus allowing the pins in the face of kick ring 300 to come clear of the holes in the face of housing 200. This then allows the housing to turn on shoulders 250 and 550 when the unit is in an operational, i.e.—vertical, position until a desired angular displacement of the housing with respect to the mandrel may be obtained. The engagement of shoulders 250 and 550 prevents the housing from continuing on a downward path when the retaining nut is loosened, thus permitting the kick ring to be backed off from the face 260 of the housing to let the pins clear the holes in face 260. This then allows the angular adjustment described above to be made.

Jam nut 600 is provided with a set of internal threads 610 to mate with external threads 510 on the mandrel. Housing 200 has an internal thread 210 in its upper end 220 larger in diameter than the jam nut 600, thus permitting the jam nut to be threaded onto the upper end 520 of the mandrel through the upper end 220 of the housing. Top sub 100 may thereafter be threaded into the upper end 220 of the housing.

A bottom face 620 of the jam nut engages abutment 270 when in place to retain mandrel 500 within housing 200. When retaining nut 400 is tightened, face 620 abuts abutment 270 firmly and flush, creating a rigid structure.

Referring to FIG. 2, it will be seen that kick ring 300 has a face 310 inclined at a 1° angle from normal to the axis of the kick ring. Thus, face 310 is not parallel to opposite face 330. Kick ring 300 thus has a "short side", i.e., it has one point about its circumference where the length of its side is shorter than at any other point.

Figure 4:
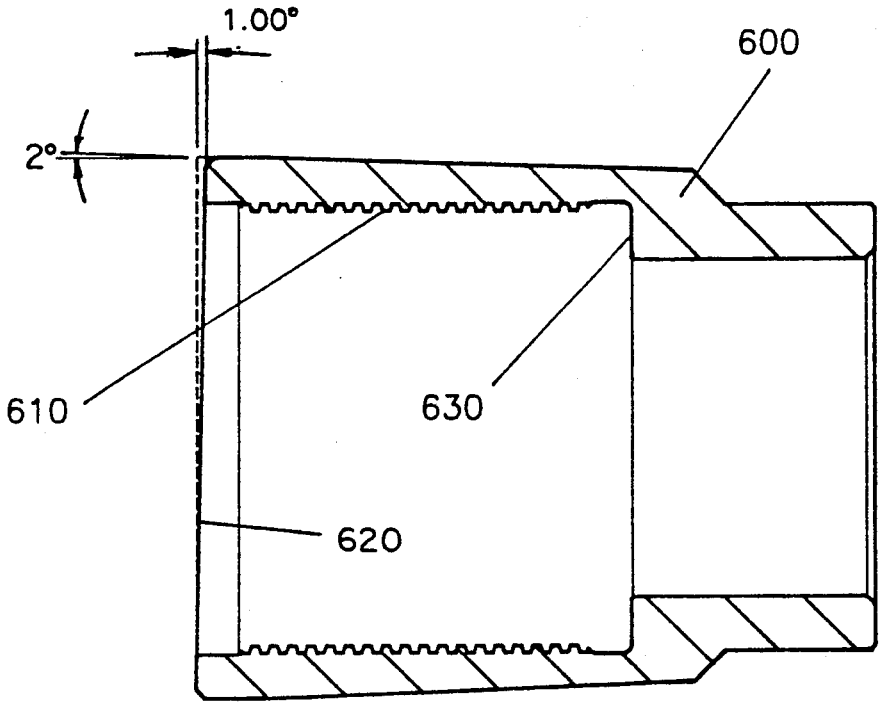
FIG. 4 is a longitudinal sectional view of the jam nut.
Figure 5:
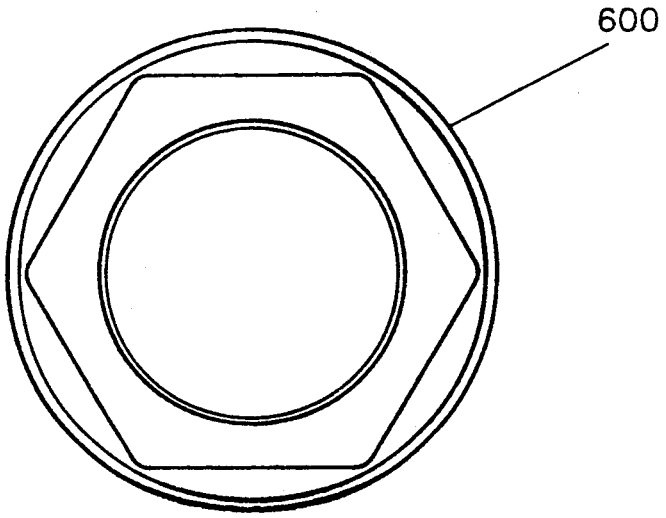
FIG. 5 is an end view of the jam nut of FIG. 4.
Figure 6:
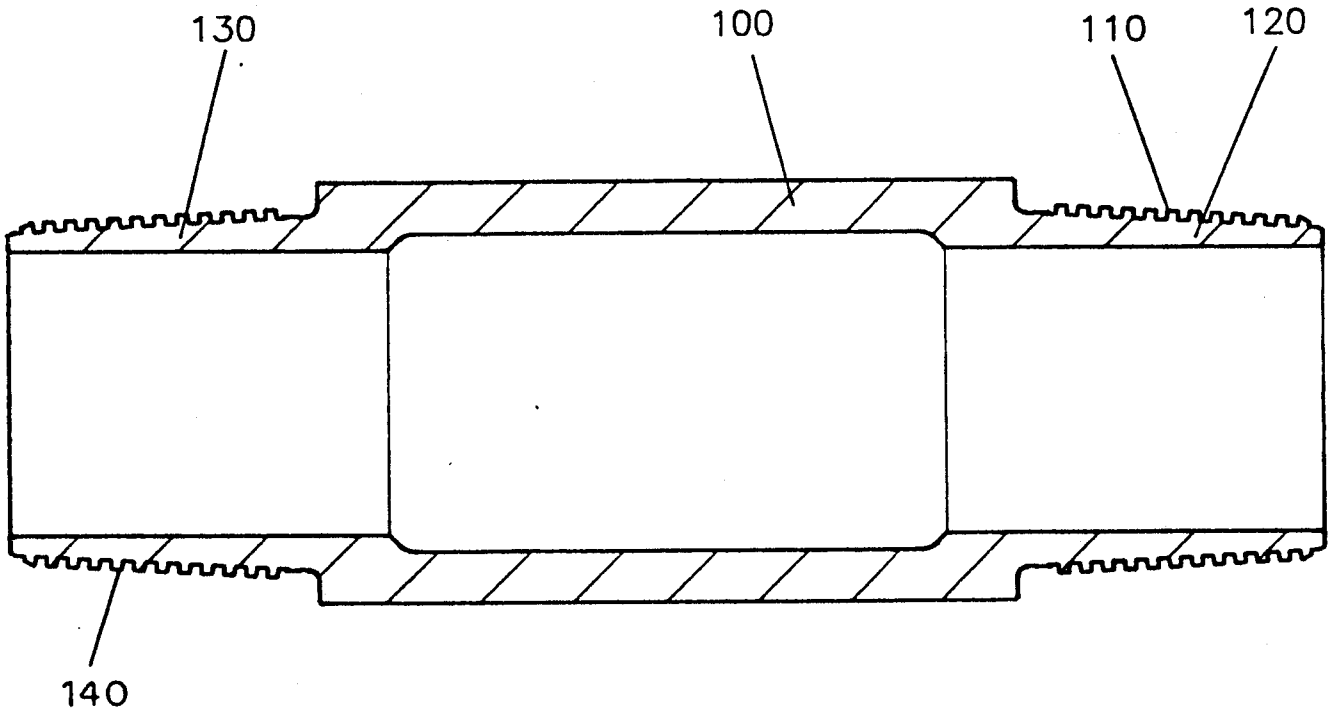
FIG. 6 is a longitudinal sectional view of the top sub.

Similarly, jam nut 600 has a face 620 which is machined 1° off normal to the axis as shown in FIG. 4, thus also having a "short side", and a "long side".

Figure 7:
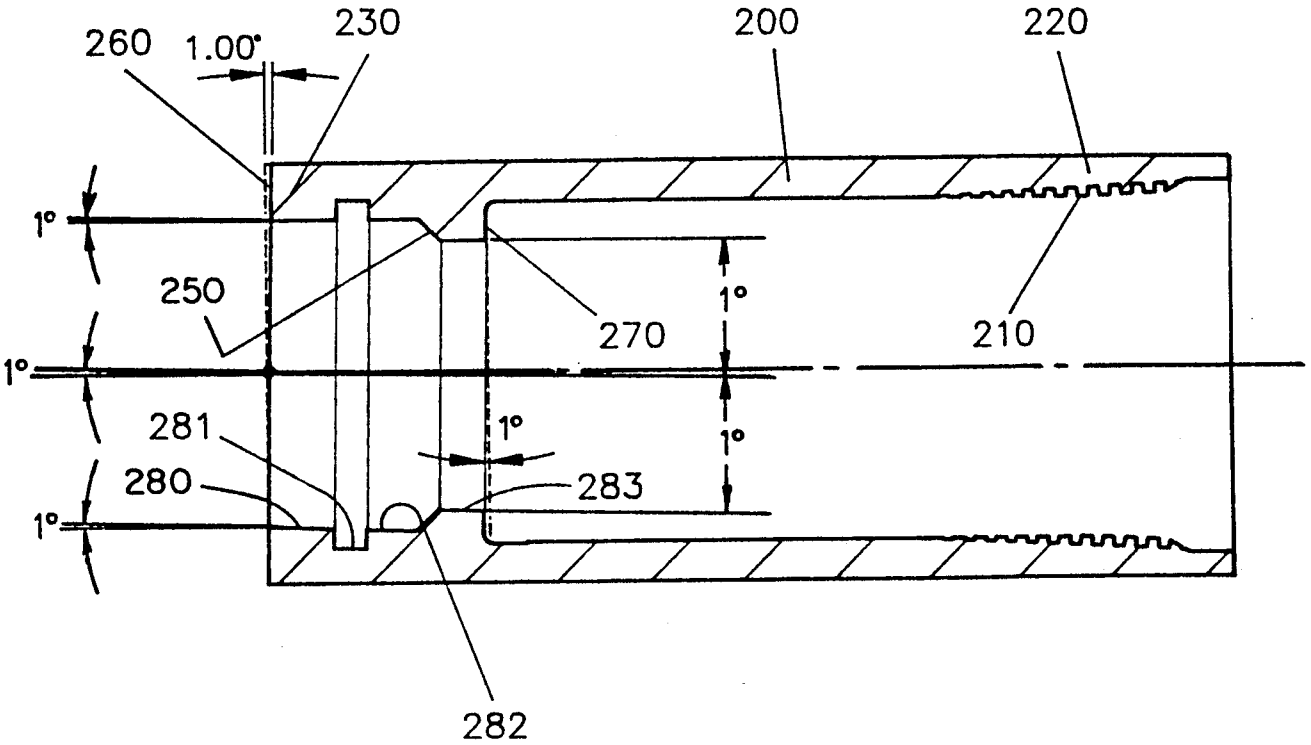
FIG. 7 is a longitudinal sectional view of the housing.
Figure 8:
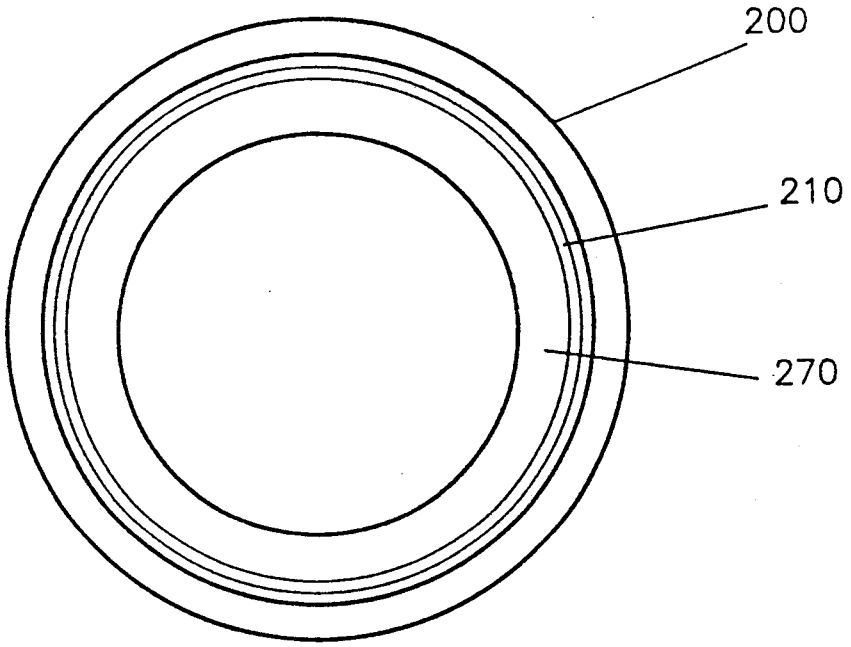
FIG. 8 is an end view of the housing of FIG. 7.

Referring to FIG. 7, housing 200 has abutment 270 which is also machined at an angle of 1° off normal to the axis of housing 200. Face 260 is machined parallel to abutment 270, thus also describing a plane 1° off normal to the axis of housing 200 and giving the housing a "short side" and a "long side".

Shoulder 250 is centred about an axis which is milled at an angle of 1° off normal to the axis of the housing 200. Internal surfaces 280, 281, 282, and 283 are also centred about axes which are 1° off normal to the axis of housing 200. Moreover, these internal surfaces 280, 281, 282 and 283 are milled at a further 1° offset normal to their own axis, thus forming slightly conical surfaces. In consequence, internal surfaces 280 through 283 are in fact parallel to the axis of housing 200 at one point in their circumference (located at the top of the drawing in FIG. 7) and are 2° off parallel to the axis of the housing 200 at an opposite point on the circumference (as shown at the bottom of the drawing in FIG. 7).

Figure 3B:
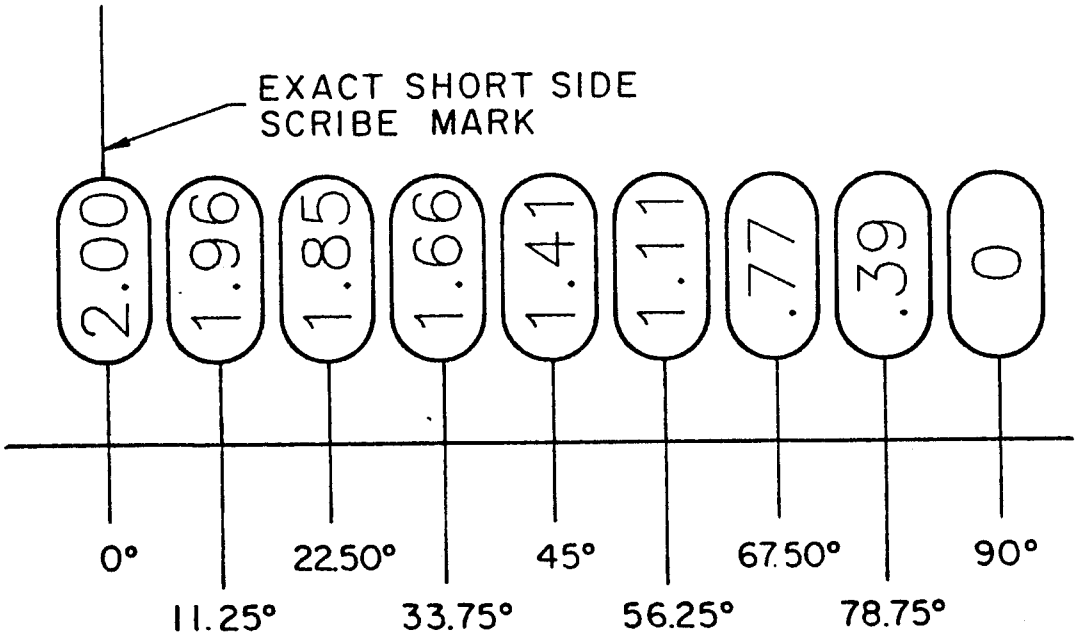
FIG. 3*b* is a view of the circumferential scale of the housing of FIG. 7.
Figure 13A:
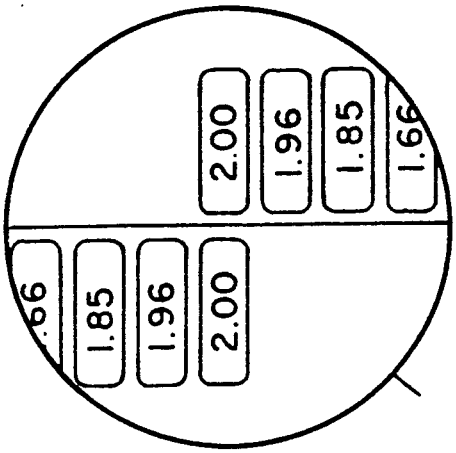
FIG. 13*a* is an enlarged view of a part of FIG. 13.
Figure 13:
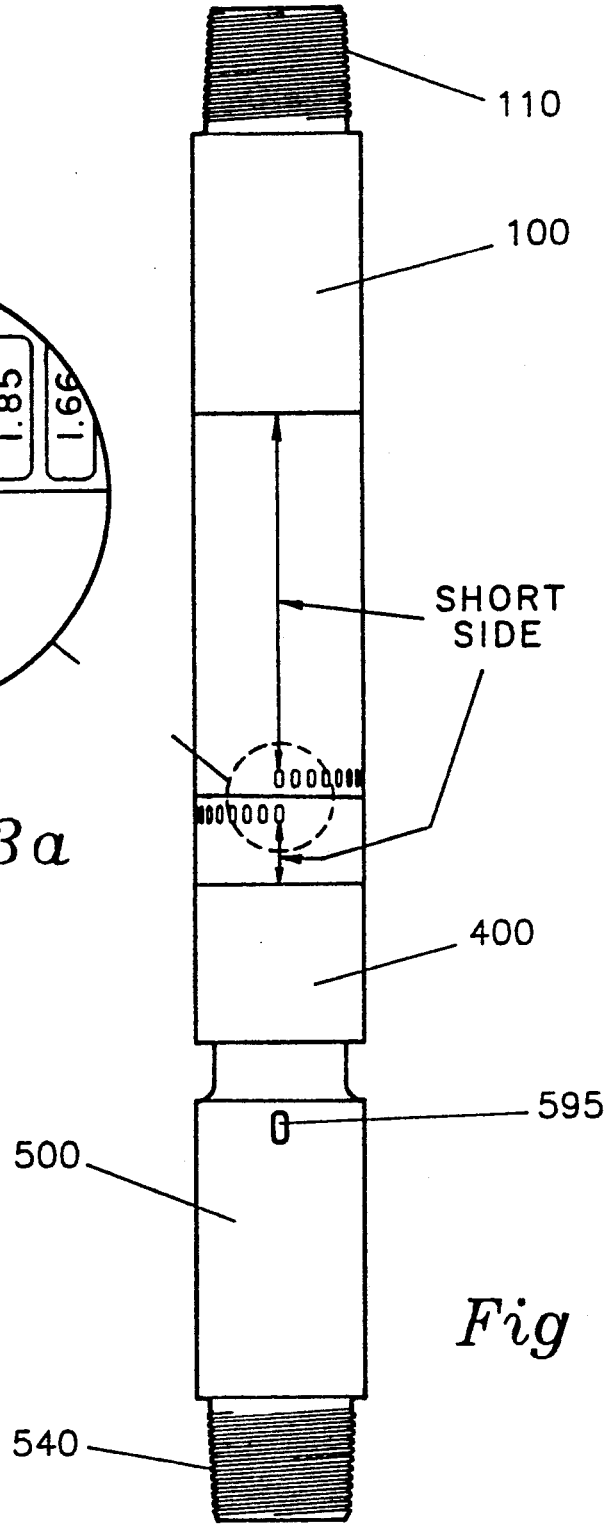
FIG. 13 is a view in elevation of the assembled adjustable bent housing of the invention, showing the location of the scribe marks when the housing is assembled in the 2° configuration.

A scale is inscribed around part of the outside circumference of the kick ring nearest face 310, ranging from 2° at the short side of the kick ring to 0° one quarter of the way around the circumference of the kick ring. FIGS. 13 and **13*a* show the scale inscribed on the kick ring. An identical but oppositely oriented scale as shown in FIG. 3*b* is inscribed on the outside circumference of the housing nearest face 260**, with the 2° mark being inscribed to indicate the point corresponding to the short side of the housing, i.e. the top of the drawing as seen in FIG. 7.

The purpose of these scales is to permit adjustment of the angle of deviation of the sub. By aligning a given angle on the kick ring with the same angle marked on the housing, the amount of deviation through the length of the sub may thus be accurately set.

Before manufacture of the unit is complete and it is ready for use, the jam nut must first be "timed". This is done during manufacture prior to the machining of the 1° face on the jam nut. The kick ring is first mounted on the mandrel during assembly such that the short side of the kick ring (i.e.—the 2° scribe mark) is aligned with a scribe mark 595 arbitrarily positioned on the mandrel. Once assembled onto the mandrel, the kick ring cannot be rotated with respect to the mandrel, and this scribe mark will thereafter mark the short side of the kick ring.

The entire assembly is then assembled in a 0° configuration—i.e.—so that the axes of all components lie in a collinear fashion and off-normal face 310 is parallel to off-normal face 260 and off-normal abutment 270. Thus, the short side of the kick ring is in line with the long side of the housing. Jam nut 600 is then put on and tightened to a torque of 5,000 ft/lbs. The jam nut is marked at the same angular location as the scribe mark 595—i.e., the short side of the kick ring—provided on the outside of the mandrel in order to provide a repeatable predetermined angular position for the jam nut when fully assembled onto the mandrel. The jam nut is then undone and a 1° face is machined onto the face 620 of the jam nut such that the long side of the jam nut will coincide with the point just marked on the jam nut. Thus, face 620 will become parallel and flush with engaging abutment 270 of the housing when reinstalled and tightened to 5,000 ft/lbs. The newly machined face 620 will be parallel to abutment 270 of the housing when assembled in the 0° configuration.

The jam nut is then reinstalled on to the mandrel. Face 590 of the upper end 520 of the mandrel engages shoulder 630 of the jam nut and this assembly is then tightened to 5,000 foot pounds.

When the unit is then assembled with the 0° mark on the circumferential scale of the housing positioned opposite the 0° mark on the circumferential scale on the kick ring, all parts of the assembly will be collinear, and all off-normal faces will be parallel, giving a deviation of 0° throughout the length of the sub.

Thereafter, the unit can be adjusted in the field by unscrewing the retaining nut 400, moving it back approximately ½ inch, and sliding back the kick ring along the keys until the dowel pins disengage the holes in the face 260 of the housing. The housing may then be rotated with respect to the kick ring to the desired angular deviation as indicated by the scribe mark on the housing against the circumferential scale on the kick ring.

When the desired angular deviation has been selected, the dowel pins may then be re-engaged in the face 260 of the housing and the retaining nut 400 tightened to 10,000 ft/lbs. This firmly tigthens the abutment 270 of the housing to face 620 of the jam nut while faces 260 of the housing and 310 of the kick ring also tighten.

As the angular position of the housing is adjusted with respect to the kick ring as just described, the upper end 520 of the mandrel will be rotated within the conical surfaces 280, 281, 282, and 283 of the housing without binding. At any angular position into which the mandrel is fixed by the retaining nut and kick ring, each pair of off-normal faces 310 and 260, and 270 and 620, will engage each other in a parallel and therefore flush fashion, providing uniform pressure across each face. Thus, the entire assembly will be rigidly held when tightened while providing a deviation in angle of direction through its length.

Figure 9:
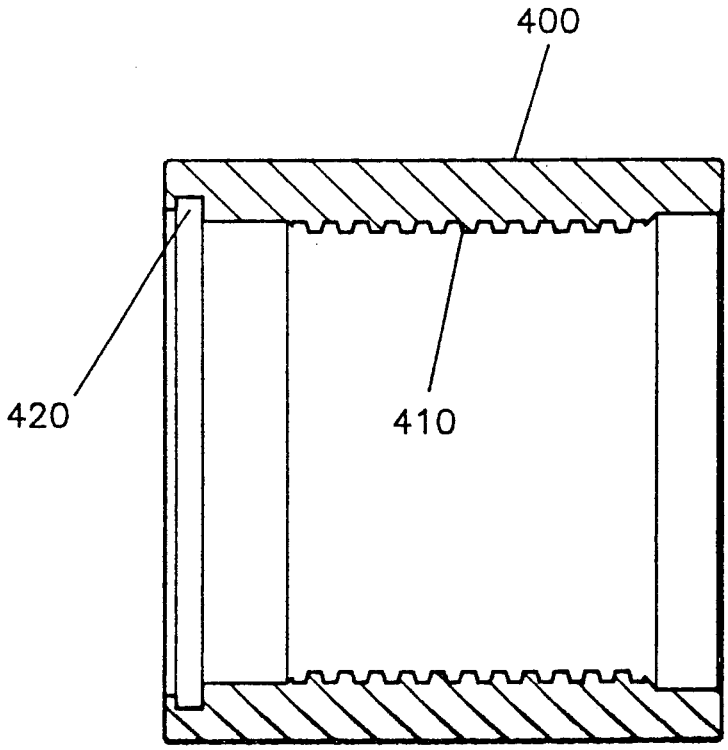
FIG. 9 is a longitudinal sectional view of the retaining nut.
Figure 10:
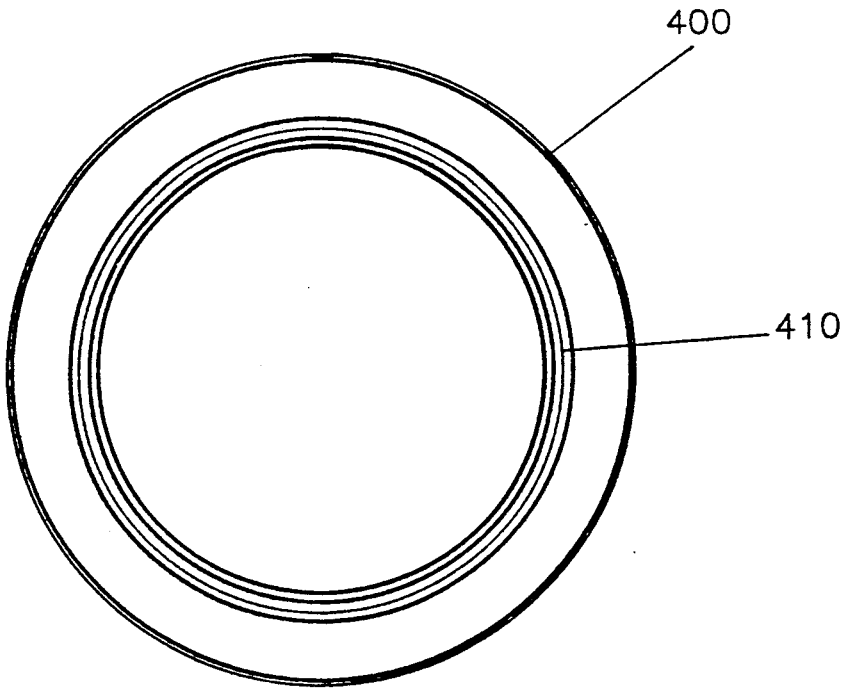
FIG. 10 is an end view of the retaining nut of FIG. 9.

As shown in FIG. 7, a channel defined by conical surface 281 is provided in the housing. An O ring may be inserted here and the interior of the housing packed with grease to prevent outside material from entering the adjustable bent housing due to the enormous pressures present in a down-hole drilling installation. Similarly, FIG. 9 shows a similar channel 420 for an O ring which may optionally be incorporated into the invention for the same purpose.

FIG. 2 shows as well that chisel points 350 may preferentially be provided about the circumference of the kick ring to aid in loosening of the kick ring in the field.

It is to be understood that the description herein has been provided by way of illustration only, and that numerous alternatives may be envisaged to the specific details of the embodiment shown. For example, the off normal faces may all be machined at a different angle, for example 1.5° instead of 1°, thus providing a total of 3° of adjustment available from the adjustable bent sub. A total of 12 dowel pins in 24 holes may be provided for improved coupling of the face of the housing with the kick ring. Alternatively, dowel pins may be provided equal in number to the number of holes provided in the face of the housing.

Thus, the description given should not be taken to limit the scope of the invention, which is defined by the claims which follow.

What we claim as our invention is:

1. An adjustable bent sub for a down hole drilling system including:

hollow cylindrical box means having a first end and a second end and having internal shoulder means disposed on a plane inclined at a predetermined angle from normal to the axis of the hollow cylindrical box means;

hollow cylindrical pin means adapted to be slidably inserted within the first end of the box means;

pin retaining means located within said box means and adapted for attachment to the inserted end of the pin means and having a face inclined at the predetermined angle from normal to the axis of the pin retaining means for engagement with the internal shoulder means for retaining the pin means within the box means;

tightening means located at the first end of said box means for tightening the pin means to the box means;

whereby the pin means may be rotatably adjusted within the box means prior to tightening of the tightening means to provide an adjustable angular deviation in the axis of the sub.

2. The apparatus of claim 1 wherein the box means includes an internal conical surface having an axis disposed parallel to the axis of the internal shoulder means and positioned between the first end of the box means and the internal shoulder means, the internal conical surface diverging from the axis thereof in the direction away from the first end of the box means at an angle equal to said predermined angle.

3. The apparatus of claim 2 wherein the tightening means includes:

kick ring means movable only in an axial direction along an outer surface of the pin means, said kick ring means having a face for engagement with a face of the box means, the face of the box means being in a plane parallel to the internal shoulder means and the face of the kick ring means inclined at the predetermined angle from normal to the axis of the kick ring means; and kick ring retaining means for releasably retaining the kick ring means in engagement with the box means.

4. The apparatus of claim 3 wherein the kick ring means includes at least one equally spaced dowel pin means projecting axially from the face thereof and the face of the box means includes a number of equally spaced holes not less than the number of dowel pin means for receiving the at least one dowel pin means when the face of the kick ring means is in engagement with the face of the box means.

5. The apparatus of claim 4 wherein the number of dowel pin means is 8 and the number of holes is 16.

6. The apparatus of claim 4 wherein the number of dowel pin means is 12 and the number of holes is 24.

7. The apparatus of claim 5 including circumferential scale means for indicating the degree of angular deviation in the axis of the bent sub.

8. The apparatus of claim 6 including circumferential scale means for indicating the degree of angular deviation in the axis of the bent sub.

9. The apparatus of any of the claims 1 through 8 wherein the predetermined angle is approximately 1 degree.

10. The apparatus of any of the claims 1 through 8 wherein the predetermined angle is approximately 1.5 degrees.

* * * * *